US005832546A

United States Patent [19]

Inch

[11] Patent Number: 5,832,546

[45] Date of Patent: Nov. 10, 1998

[54] FLUSH TOILET HAVING A RESEAL WATER CHAMBER

[75] Inventor: John D. Inch, Kansas City, Mo.

[73] Assignee: Metcraft, Inc., Kansas City, Mo.

[21] Appl. No.: 747,981

[22] Filed: Nov. 12, 1996

[51] Int. Cl.[6] ..... E03D 1/18

[52] U.S. Cl. ..... 4/333; 4/425

[58] Field of Search ..... 4/422, 423, 425, 4/333, 336

[56] References Cited

U.S. PATENT DOCUMENTS

| | | | |
|---|---|---|---|
| 846,367 | 3/1907 | Whiteford . | |
| 1,016,676 | 2/1912 | Dale . | |
| 1,630,861 | 5/1927 | Opdyke . | |
| 1,998,861 | 4/1935 | Campus | 4/425 X |
| 2,182,979 | 12/1939 | Bruzenak . | |
| 3,010,115 | 11/1961 | Wiggs | 4/422 X |
| 4,996,726 | 3/1991 | Schrock et al. . | |
| 5,054,133 | 10/1991 | Pickerell et al. . | |
| 5,067,181 | 11/1991 | Hafner et al. | 4/425 |

*Primary Examiner*—Charles E. Phillips
*Attorney, Agent, or Firm*—Reising, Ethington, Learman & McCulloch

[57] ABSTRACT

A flush toilet (10) is operated by a flushometer (14) which passes water to a water chamber (36). The chamber is sized to assure that the bottom (48) of the toilet bowl and waste outlet (22) are resealed against sewer gas backup. The chamber has outlets (30) and (32) that direct water to a jet outlet (20) and a rim rinse outlet (21) to flush the toilet and provides drainage of water after the flushometer is closed to reseal the toilet bowl (12).

11 Claims, 2 Drawing Sheets

FLUSH TOILET HAVING A RESEAL WATER CHAMBER

TECHNICAL FIELD

The field of this invention relates to flush toilets and more particularly to low water consumption toilets with a flush valve.

BACKGROUND OF THE DISCLOSURE

Flush toilets have long been designed to provide complete flushing of all the waste from the toilet bowl and to refill the bowl with clean water. Adequate flushing has long been assured by a sufficient amount of water from either a tank accompanied with operable flush and refill valves or with a flushometer. In old toilet designs, a single flush could consume more than six gallons of water and the pressure may have been supplied by a tank located more than six feet above the toilet bowl.

Toilets are a significant source of water usage. Reductions of toilet water usage provide a significant reduction of clean water usage, a significant decrease of water sent to sewage filtration plants and a significant reduction sent to septic fields. Lower water consumption toilets are becoming an important part of any sound and reasonable environmental management plan.

Furthermore, toilet water tanks have been replaced in commercial, industrial and institutional buildings by flushometers. The advantage of the flushometer is that it eliminates the need of a large and cumbersome water storage tank and replaces two valves, the flush valve and the refill valve with a single flushometer valve. The flushometer is connected to a high flow pressurized water supply line that is capable of providing sufficient flow from the water supply line. Presently, flushometers are available with various outputs such as 3.5 gallons, 1.6 gallons and 1 gallons per flush models depending on the local ordinances and the model of the toilet bowl. However, the basic construction for the flushometers for the different. outputs are substantially the same. The variance in output is accomplished merely by placing a restrictor (usually in the form of a restricting ring) at the outlet for the flushometer.

Present flushometers are suppose to do two things. Firstly, to adequately flush all waste from the bowl and secondly, to refill the bottom of the bowl for resealing the trap from the bowl to prevent sewer gas from backing up from the waste pipe and through any empty trap into the bowl.

The flushometers work quite well with china or porcelain toilet fixtures. Many porcelain toilet fixtures work on a siphon principal where the water floods the toilet bowl and the siphon action takes over to suck the water out of the bowl over the trap of the toilet until the siphon seal at the bottom of the bowl outlet is broken. Only a little water is needed to fill the bowl over the outlet to reseal the trap against the backup of sewer gases because the water level does not drop significantly below the top edge of the waste outlet.

Presently constructed flushometers have not been a successful for stainless steel toilet fixtures. Stainless steel toilet fixtures are used in places where durability of the toilet is needed. Stainless steel toilets are commonly seen in prisons or in large public parks or other institutions where the porcelain toilets would be damaged. These stainless steel toilets due to their different construction do not work on the siphon principal but work by use of a jet orifice or bowl jet outlet placed at the bottom of the tank and the action of the jet blows out the water.

The problems in providing successful flushes to such stainless steel toilets by flushometers are due to the nature of the flush action. The two stages of the flushometer cycle, the flushing stage of the waste water and the refilling and resealing stage of the toilet bowl work against each other. A flushometer when actuated has the water blowing out through the jet orifice to empty the bowl. However, once the flushometer shuts off, the remaining water in the pipes between the flushometer and the toilet bowl is insufficient to refill the bowl to the level above the waste outlet to reseal the bowl against sewer gas backup.

The prior art method to provide sufficient water to refill and reseal the bowl against sewer gas backup is to put a restrictor ring in the flushometer to put back pressure on the operating diaphragm of the flushometer such that the closing action of the flushometer valve is slowed down to provide more water for refill purposes. The use of common restrictor rings while satisfactory for a china porcelain toilet fixture provides compromises to the flush in a stainless steel toilet. While the restrictor ring slows down the closing of the flushometer to allow an increased amount of water to replenish the bowl bottom at a slow rate near the end of the flushometer cycle, the same restrictor ring lessens flow rate out of the flushometer during the first stage of the flushometer cycle. The restrictor restricts the flow lower than the flow rate capacity of the bowl jet outlet and therefore decreases the flushing action from the bowl jet outlet. The lower flush rate at the beginning of the flush cycle is at a cost of the flush actuation energy. In other words, the restrictor ring compromises the flush cycle to leave water at the bottom of the bowl to bring the level up high enough to reseal the trap. Thus, a successful reseal of the trap often relies on a less than complete flush at low water consumption levels.

With the present construction of the water piping leading from the flushometer to the toilet, an insufficient amount of water is provided to form a reseal of the toilet bowl bottom if the bowl is completely emptied as is desired to assure that all waste is removed from the bowl with each flush.

The compromise to the flush is even further aggravated at lower water consumption levels. For example, if the objective is to use 1.6 gallons for the entire flush cycle and it takes 0.75 gallons (3 quarts) to reseal the bowl bottom once it is empty, only 0.85 gallons is available for the entire flush stage to rid of the waste in the bowl. In other words, a greater percentage of the water in the flush cycle (almost half in this example) is needed for resealing of the bowl trap relative to water used to flush the waste out of the bowl. As a result, as flushometers provide less water due to the restrictor ring, the adequacy of the flush is compromised.

What is needed is a toilet flush system for presently available flushometers that will provide a complete flush with high activation energies, while providing sufficient water to the bowl to reseal the trap after the flush valve is closed.

SUMMARY OF THE DISCLOSURE

In accordance with one aspect of the invention, a flush toilet has a bowl, a bowl jet outlet in a bottom section of the bowl, a rim rinse outlet at an upper section of the bowl, a waste outlet leading from the lower section of the bowl with a defined upper edge and connected to a waste pipe to form a trap, a water line tubes having downstream ends connected to the bowl jet outlet and the rim rinse outlet and connected upstream to an operable flushometer that upon actuation provides water to flush the toilet. The flush toilet has its water lines between the flushometer and the toilet tank sized to have a volume that is less than the volume of water flushed at each cycle and also sized to retain more water than needed to fill the bottom of an empty toilet bowl to a level higher than the upper edge of the waste outlet. This level of water is sufficient to seal the trap when the water line is drained after the flushometer closes.

Preferably, the proper volume within the water line is accomplished by the inclusion of a water chamber that has a diameter substantially greater than the water piping connected to the outlet side of the flushometer and to the inlet of the water chamber. The water chamber also has at least one outlet to pass water through tubes connected to the rim rinse and bowl jet outlets.

The water chamber is normally empty before actuation of the flushometer and fillable upon actuation of the flushometer to receive water and pass it to the rim rinse and bowl jet for allowing flush action in the bowl. The bowl jet outlet and rim rinse outlet have sufficient restriction to provide back pressure to fill up the water line including the water chamber, water piping, and water tubes during the actuation of the flushometer and allow said water piping, water chamber and tubes to empty after the flushometer closes. As a result passing water therefrom to the bowl covers the waste outlet and seals the trap to prevent gas from passing back from the waste pipe and into the bowl.

It is desirable that the water chamber has a first outlet connected to a first tube connected to the bowl jet and a second tube connected to the rim rinse outlet. In one embodiment, the second outlet is at an upper portion of the water chamber such that upon closing of the flushometer, the water passes from the water chamber and through the first tube and through the bowl jet outlet and air passes from the rim rinse outlet and through the second tube and into the water chamber. In another preferred embodiment, a vacuum breaker is at the outlet side of the flushometer and above the water chamber to provide air into the water pipes and chamber as the water drains therefrom and into the toilet bowl after the flushometer closes.

Preferably, the water chamber has a generally cylindrical shape and is made from a roto-molded low linear polyethylene. In one embodiment, the water chamber is oriented in a generally horizontal disposition with a horizontal longitudinal axis. The inlet is connected to an end wall of the water chamber and two outlets are connected to the bottom portion of the cylindrical side wall of the water chamber. In another embodiment, the water chamber is oriented in a generally vertical disposition with a vertical longitudinal axis. The inlet is connected to a cylindrical side wall of the water chamber and the first outlet is connected to a bottom end wall of the water chamber.

Alternatively, the inlet is connected to a top end wall of the water chamber and the first outlet is connected to a bottom end wall of the water chamber. A hold back tube is connected to the first outlet extending up to an upper section of the water chamber and having an open top end. The hold back tube has restrictive drain reseal holes at its bottom to allow the water chamber to empty therethrough after the flushometer is closed and to reseal the trap at the bottom of the toilet bowl.

In this fashion, it is assured that a flushometer can provide adequate flushing of the waste water by blowing out the waste through a jet orifice and still assure that the bowl becomes refilled sufficiently to reseal the trap against sewer line backup.

BRIEF DESCRIPTION OF THE DRAWINGS

Reference now is made to the accompanying drawings in which.

DETAILED DESCRIPTION OF THE PREFERRED EMBODIMENT

Figure 1:
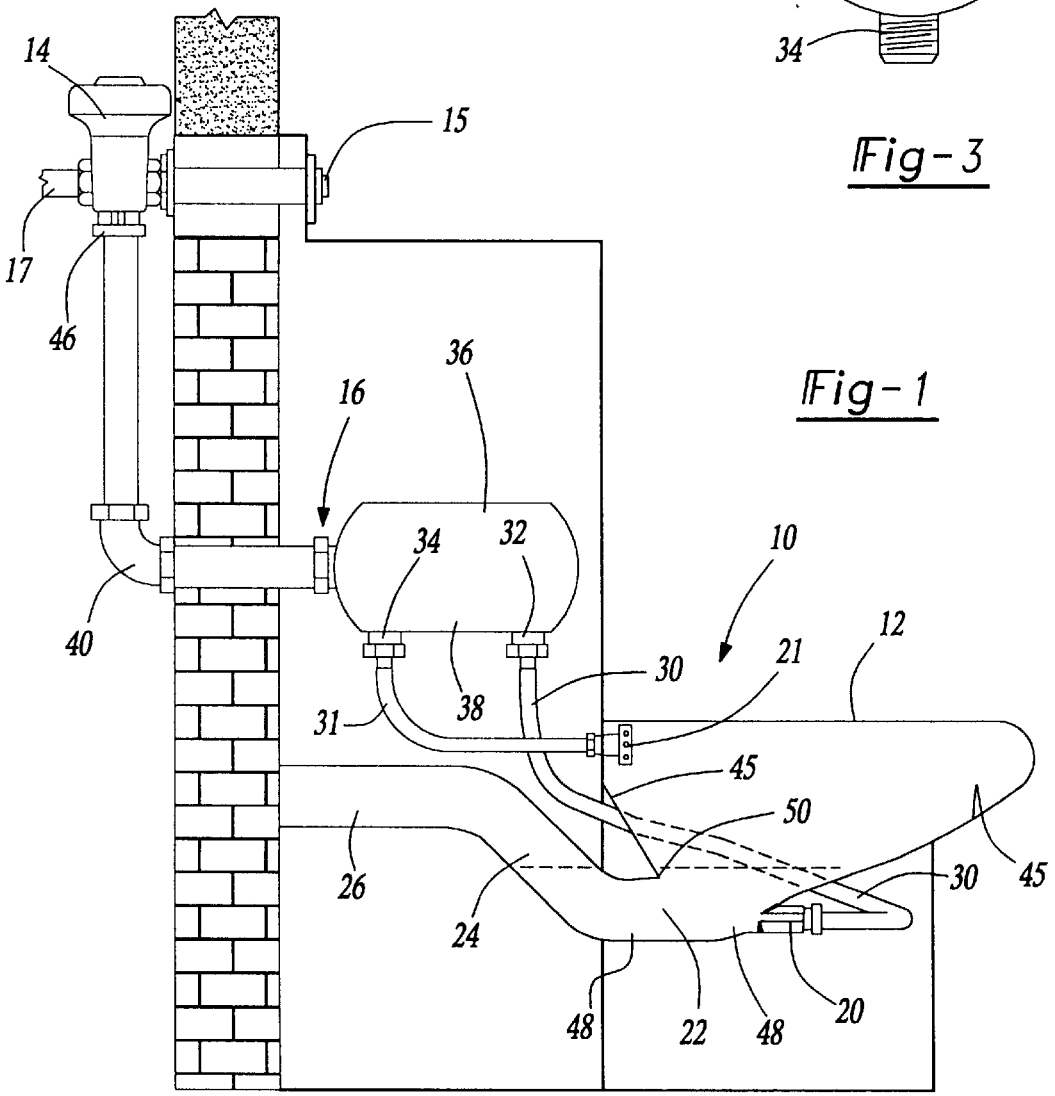
FIG. 1 is a side elevational and partially schematic view of a flush toilet illustrating one embodiment of the invention.

Referring now to FIG. 1, a flush toilet generally indicated as 10 has a stainless steel toilet bowl 12. A commercially available flushometer 14 such as a Royal Sloan valve is actuated by a push button 15 to supply water from a water supply 17. Water lines extend downstream of the flushometer generally indicated as 16. A bowl jet outlet or jet fitting 20 and a rinse outlet or rinse fitting 21 are at the downstream end of the water line 16 and empty into the toilet bowl 12. The jet fitting is positioned at the front bottom of the toilet bowl and is aimed rearwardly to shoot water into the waste outlet 22. The waste outlet 22 has an upwardly extending trap leg 24 to form a trap for sewer gases from the waste tube 26.

Figure 2:
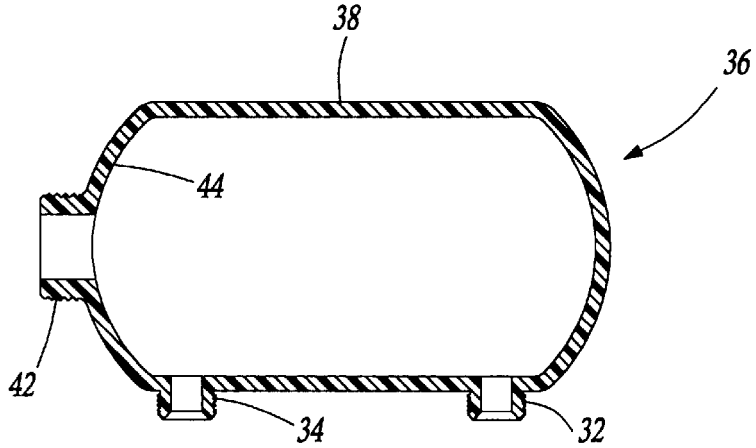
FIG. 2 is a cross sectional side elevational view of the water chamber shown in FIG. 1.
Figure 3:
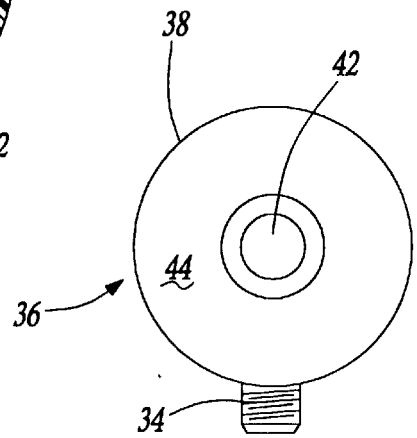
FIG. 3 is a side end view of the water chamber shown in FIG. 1.

The water line 16 includes a water tube 30 having a downstream end connected to the jet fitting 20 and a water tube 31 connected to the rim rinse fitting 21. The upstream ends of each tube 30 and 31 are connected to respective outlets 32 and 34 of a water chamber 36 in water line 16. The water chamber 36 is a roto molded low linear polyethylene (LLPE) vessel. It is generally cylindrical in cross-section as shown in FIG. 3 with a generally horizontal disposition such that the longitudinal axis of the chamber is horizontal. The inlets 32 and 34 are at the bottom portion of a side cylindrical wall 38 of the water chamber 36.

The water line 16 also includes piping 40 extending from the flushometer to an inlet 42 at an end wall 44 of the water chamber 36. The internal diameter of the water chamber 36 is substantially larger than the internal diameter of the water piping 40. Water piping 40 has a vacuum breaker tube 46 at its upstream end in proximity to the flushometer 14. The inlet 42 and outlets 32 and 34 of water chamber 36 may be provided with threaded connections for ease of installation.

The total volume of the water line 16, i.e. the water piping 40, the water chamber 36 and the tubes 30 and 31 is greater than the combined bottom 48 of bowl 12 and waste outlet 22 below the upper edge 50.

In operation, the flushometer 14 can be used without its restrictor ring so that when actuated, it provides a great burst of water through the water piping 40 and into chamber 36 and through tubes 30 and 31 to rinse fitting 21 and jet outlet 20. The jet outlet 20 shoots the high pressure water into the toilet bowl to force the waste water up through the leg 24 and out through the waste tube 26. Simultaneously, some water is also directed down the upstanding walls 45 of the bowl through rim rinse fitting 21.

The jet outlet 20 and rim rinse fitting 21 have sufficient restriction to cause water to fill up within chamber 36 during the flush cycle. The flushometer provides more water per cycle than the total volume of the water line 16 to assure a proper flush for each actuation of the flushometer.

The force of the water through the jet nozzle from the high pressure output of the flushometer completely empties the bowl and waste outlet. The high pressure water entering into the chamber 36 mixes with the air therein to highly aerate the water which assists in providing a greater volume of water-air mix to flush the waste from the bowl 16.

The flushometer than automatically closes. The closure does not need to be slowed down in any fashion. Thus no back pressure is needed on the flushometer diaphragm for it to operate successfully. The closure may be sudden and abrupt after the metered amount of water passes at a high flow rate therethrough. Hence, any restriction ring may be eliminated. The water within the water line 16 including piping 40, chamber 36 and tubes 30 and 31 then drains down into the bowl 12 to fill the bottom 48 until the water is above edge 50 of the outlet to reseal the trap 24 from sewer gas backup. The vacuum breaker tube 46 promotes a quiet and complete drainage of the water line by allowing air to enter therein.

For example, if the bowl bottom 48 takes 3 quarts (0.75 gallons) to cover upper edge 50 which is a common toilet capacity, then the water line 16 needs to have an internal volume of at slightly more than 3 quarts (0.75 gallons). The chamber may provide 2 quarts of water while the piping 40 and tubes 30 and 31 provide the remaining third quart. For a 1.6 gallon low water consumption flush cycle, this allows nearly 0.85 gallons of high pressure water to empty the waste water which has been found to successfully empty such toilet bowls. Such a cycle including the refilling or resealing of the toilet bowl can be completed within 15 seconds.

Figure 4:
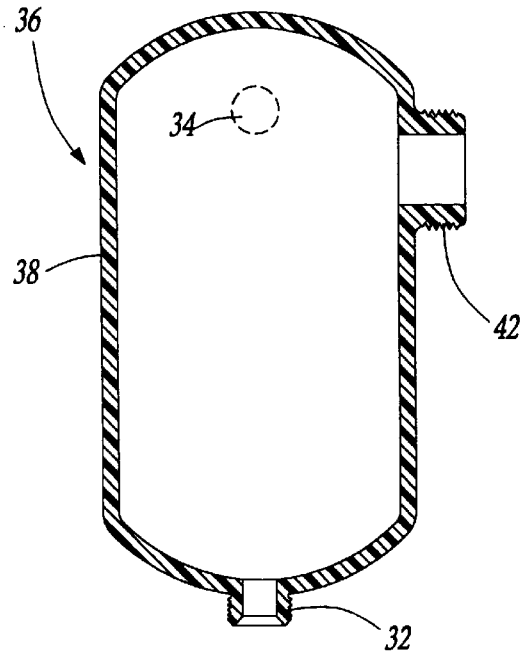
FIG. 4 is a cross-sectional view of a second embodiment of a water chamber.

Variations of the water chamber 36 are shown in FIGS. 4–7. In FIG. 4, a vertically oriented cylindrical chamber is shown with outlet 32 at a bottom end wall and outlet 34 at an upper section of cylindrical side wall 38. Similarly, inlet 42 is connected to an upper section of cylindrical side wall 38. The functioning of this second embodiment is similar to the first described embodiment. The major difference is that the chamber is mostly drained through the tube 30 leading to the jet outlet 20. The tube 31 functions as an air vent to allow air back into the chamber as the water drains through outlet 32. This water chamber allows acceptable functioning of the chamber without the vacuum breaker tube 46.

Figure 5:
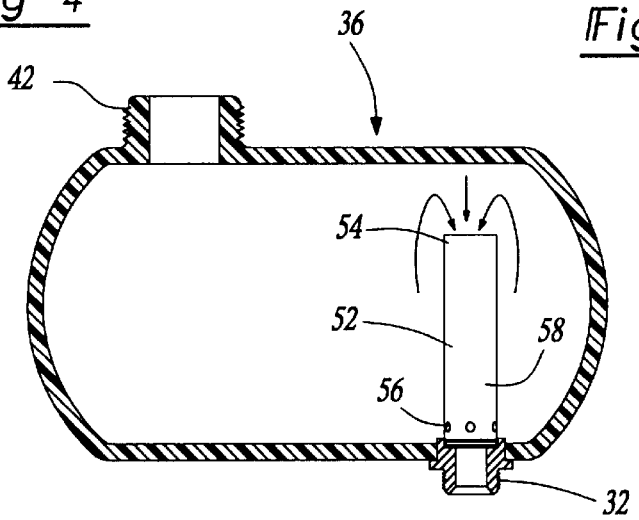
FIG. 5 is a cross-sectional view of a third embodiment of a water chamber.
Figure 7:
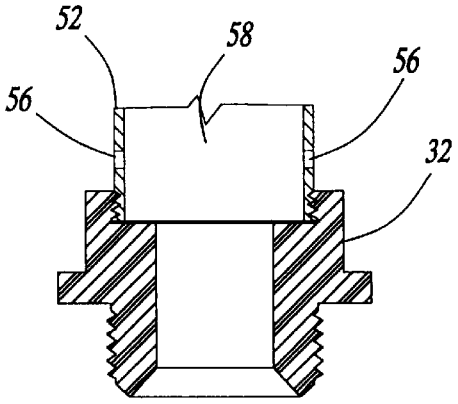
FIG. 7 is an enlarged view of the drain holes of the hold back tube shown in FIG. 6.

A third variation is illustrated in FIG. 5. This water chamber 36 has a single water outlet 32 at a bottom section of the cylindrical side wall 38 which is connected to a single tube (not shown) which then downstream splits into tubes 30 and 31. The inlet 42 is connected to an upper section of the cylindrical side wall 38. A hold back tube 52 extends from the outlet 32 to an upper section of chamber 36. The hold back tube 52 has an upper open end 54 and slow release drains holds 56 about the lower section 58 of the hold back tube.

The function of this water chamber is similar to the first described water chamber. The major difference is that the water fills the chamber and aerates with the air within for a slight period of time while the hold back tube delays the major thrust of the high pressure water from passing down to the jet outlet 30 and flushing the toilet.

Figure 6:
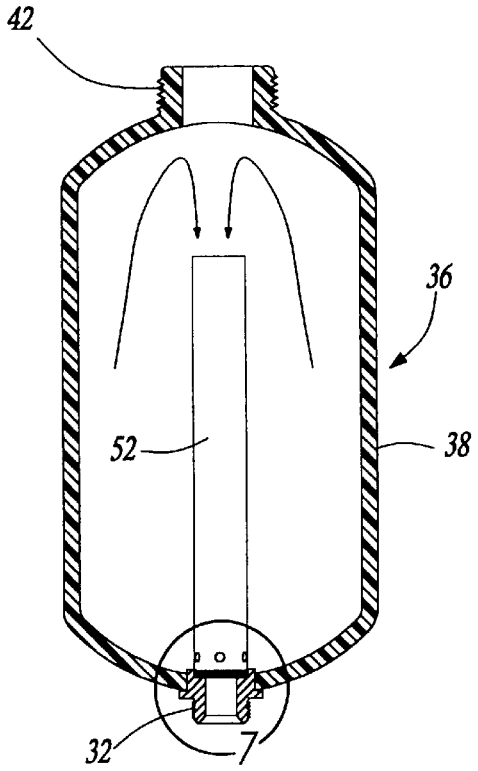
FIG. 6 is a cross-sectional view of a forth embodiment of a water chamber.

A further variation showing a hold back tube 52 is illustrated in FIG. 6. In this variation, the water chamber is generally vertically oriented with the inlet at an upper end wall and the outlet at the bottom end wall. This hold back tube 52 also has drain holes 56 about the lower section 58 thereof as more clearly shown in FIG. 7.

While cylindrical chambers have been described, other shapes such as box shaped chambers are foreseen. The chambers can also be made from other materials such as stainless steel.

Other variations and modifications are possible without departing from the scope and spirit of the present invention as defined by the appended claims.

The embodiments in which an exclusive property or privilege is claimed are defined as follows:

1. A flush toilet having a bowl, a bowl jet outlet in a bottom section of the bowl, a rim rinse outlet at an upper section of the bowl, a waste outlet leading from the lower section of the bowl with a defined upper edge and connected to a waste pipe to form a trap, water tubes having downstream ends connected to the bowl jet outlet and the rim rinse outlet and connected upstream to an operable flushometer that upon actuation provides water to flush the toilet, the improvement characterized by:

a water chamber interposed between the flush valve and the rim rinse and bowl jet outlets and having an inlet to receive substantially all water from the flushometer and at least one outlet to pass water through the tubes and to the rim rinse and bowl jet outlets;

said water chamber in combination with the water pipes downstream of the flushometer having a total volume that is less than the volume of water that the flushometer passes with each flush and having a volume large enough to retain sufficient water therein when combined with the water in the water pipes downstream of the flushometer and tubes to fill the bottom of the bowl to a level higher than the upper edge of the waste outlet to seal the trap after the flushometer closes;

said chamber normally being empty of water and having air therein before actuation of the flushometer and fillable with water upon actuation of the flushometer, the water being mixed with the air in the chamber to aerate the water and pass the aerated water to the rim rinse and bowl jet for allowing flush action in the bowl;

said bowl jet outlet and rim rinse outlet having sufficient restriction to provide back pressure to fill up the chamber during the actuation of the flushometer and allow said chamber to empty after the flushometer closes such that passing water from the water chamber to the bowl covers the waste outlet and seals the trap to prevent gas from passing back from the waste pipe and into the bowl.

2. A flush toilet as defined in claim 1 further characterized by:

said bowl jet having a first tube connected to a first outlet in the water chamber;

said rim rinse outlet having a second tube connected to a second outlet in the water chamber such that upon closing of the flushometer, the water passes from the water chamber and through the first tube and through the bowl jet outlet and air passes from the rim rinse outlet and through the second tube and into the water chamber.

3. A flush toilet as defined in claim 2 further characterized by:

said second tube being connected to an upper portion of the water chamber and the first tube being connected to a lower section of the water chamber.

4. A flush toilet as defined in claim 2 further characterized by:

said water chamber having a generally cylindrical shape and having a diameter substantially greater than the water pipe leading from the flushometer and connected to the inlet of the water chamber.

5. A flush toilet as defined in claim 4 further characterized by:

said water chamber having the generally cylindrical shape oriented in a generally vertical disposition with a vertical longitudinal axis and having a diameter substantially greater than the water pipe leading from the flushometer and connected to the inlet of the water chamber.

6. A flush toilet as defined in claim 5 further characterized by:

said inlet connected to a cylindrical side wall of the water chamber and the first outlet being connected to a bottom end wall of the water chamber.

7. A flush toilet as defined in claim 5 further characterized by:

said inlet connected to a top end wall of the water chamber and the first outlet being connected to a bottom end wall of the water chamber;

a hold back tube connected to the first outlet extending up to an upper section of the water chamber and having an open top end;

said hold back tube having restrictive drain reseal holes at its bottom to allow the water chamber to empty therethrough after the flushometer is closed and to reseal the trap at the bottom of the toilet bowl.

8. A flush toilet as defined in claim 1 further characterized by:

said water chamber having the generally cylindrical shape oriented in a generally horizontal disposition with a horizontal longitudinal axis;

a vacuum breaker tube downstream and in proximity to the flushometer an located above said water chamber.

9. A flush toilet as defined in claim 8 further characterized by:

said inlet connected to an end side wall of the water chamber and the at least one outlet being connected to a bottom portion of a cylindrical wall of the water chamber.

10. A flush toilet as defined in claim 8 further characterized by:

said inlet connected to a top portion of a cylindrical wall of the water chamber and the at least one outlet being connected to a bottom portion of the cylindrical wall of the water chamber;

a hold back tube connected to the at least one outlet extending up to an upper section of the water chamber and having an open top end;

said hold back tube having restrictive drain reseal holes at its bottom to allow the water chamber to empty therethrough after the flushometer is closed and to reseal the trap at the bottom of the toilet bowl.

11. A flush toilet having a bowl, a bowl jet outlet in a bottom section of the bowl, a rim rinse outlet at an upper section of the bowl, a waste outlet leading from the lower section of the bowl with a defined upper edge and connected to a waste pipe to form a trap, a first water passage having a downstream end connected to the bowl jet outlet and a second water passage having a downstream end connected to the rim rinse outlet; said first and second water passages being connected upstream through a connected water line to an operable flushometer that upon actuation provides water to flush the toilet, the improvement characterized by:

the total volume within the water passages and water line downstream of the flushometer to the toilet bowl having a volume less than the volume of water that the flushometer passes with each flush and to retain more water than needed to fill the bottom of the bowl to a level higher than the upper edge of the waste outlet to seal the trap from when the bowl is completely empty;

said water passages and water line normally being empty before actuation of the flushometer and fillable upon actuation of the flushometer to receive substantially all water flowing from the flushometer and pass it to the rim rinse and bowl jet for allowing flush action in the bowl;

said bowl jet outlet and rim rinse outlet having sufficient restriction to provide back pressure to fill up the water passages and water line during the actuation of the flush valve and allow said water passages and water line to empty after the flushometer closes such that passing water from the water chamber to the bowl covers the waste outlet and seals the trap to prevent gas from passing back from the waste pipe and into the bowl.

* * * * *